US005218368A

United States Patent [19]

Huruno et al.

[11] Patent Number: 5,218,368

[45] Date of Patent: Jun. 8, 1993

[54] ARRAY ANTENNA WITH RADIATION ELEMENTS AND AMPLIFIERS MOUNTED ON SAME INSULATING FILM

[75] Inventors: Takayoshi Huruno; Nobutake Orime; Morio Higa; Yoshiyuki Chatani; Yasuhiko Nishioka; Masahiko Funada; Akira Harada; Toshio Masujima, all of Kamakura, Japan

[73] Assignee: Mitsubishi Denki Kabushiki Kaisha, Japan

[21] Appl. No.: 854,252

[22] Filed: Mar. 20, 1992

[30] Foreign Application Priority Data

Mar. 20, 1991 [JP] Japan ..... 3-56826

[51] Int. Cl.[5] ..... H01Q 1/38

[52] U.S. Cl. ..... 343/700 MS; 343/846

[58] Field of Search ..... 343/700 MS, 853, 829, 343/846, 701, 767, 770; 333/26

[56] References Cited

U.S. PATENT DOCUMENTS

| | | | |
|---|---|---|---|
| 3,757,342 | 9/1973 | Jasik et al. | 343/700 MS |
| 4,857,938 | 8/1989 | Tsukamoto et al. | 343/700 MS |
| 4,999,592 | 3/1991 | Kanda et al. | 343/26 |
| 5,019,829 | 5/1991 | Heckman . | |
| 5,023,624 | 6/1991 | Heckman . | |
| 5,083,132 | 1/1992 | Kanda et al. | 343/700 MS |

FOREIGN PATENT DOCUMENTS

| | | |
|---|---|---|
| 0055324 | 5/1981 | European Pat. Off. . |
| 0101791 | 4/1983 | European Pat. Off. . |
| 0346125 | 8/1989 | European Pat. Off. . |
| 12501 | 5/1988 | Japan . |
| 41505 | 2/1989 | Japan . |
| 179514 | 12/1989 | Japan . |

OTHER PUBLICATIONS

Patent Abstracts 1-114105; 1-114104; & 1-114106 (Japan).

*Primary Examiner*—Rolf Hille
*Assistant Examiner*—Hoanganh Le
*Attorney, Agent, or Firm*—Wolf, Greenfield & Sacks

[57] ABSTRACT

A radiowave receiving array antenna includes a lower grounding conductor, an upper grounding conductor, and supporting plates for supporting a feeder circuit board therebetween. Radiation elements and low noise amplifiers are mounted on the same plane of an insulating film of the feeder circuit board. The number of radiation elements is reduced, but the quality of the signal is not deteriorated.

8 Claims, 5 Drawing Sheets

ARRAY ANTENNA WITH RADIATION ELEMENTS AND AMPLIFIERS MOUNTED ON SAME INSULATING FILM

FIELD OF THE INVENTION

The present invention relates to an array antenna for receiving signals in a microwave region.

BACKGROUND OF THE INVENTION

FIG. 5*a* and 5*b* show a conventional radiowave receiving array antenna wherein reference numeral 1 designates a lower grounding conductor, numeral 2 designates a feeder circuit board, numeral 3 designates an upper grounding conductor, numerals 4 designate supporting plates, numerals 5 designate low noise amplifiers, numerals 6 designate power source lines for the low noise amplifiers, numeral 7 designates a number of radiation elements, numeral 8 designates a feeder circuit, numerals 9 designate metal pins and numeral 10 designates a number of radiation windows.

In the operation of the conventional array antenna, radiowaves received by the radiation elements 7 in the feeder circuit board are synthesized by the feeder circuit 2, the synthesized signal is amplified by the low noise amplifiers 5, and then, is supplied to a receiver. In the feeder circuit 2, a loss of electric energy produces noise, whereby the quality of an electric signal is deteriorated. When the level of deterioration exceeds an allowable range, it is necessary to divide the antenna into sub-arrays and to insert the low noise amplifiers 5 in each sub-array. Namely, influence by a loss produced in the feeder circuit from the low noise amplifiers 5 to the output terminals of the antenna can be reduced in inverse proportion to the gain of the low noise amplifiers 5 by inserting a plurality of low noise amplifiers 5 in the feeder circuit 2. In order to insert the low noise amplifiers in the feeder circuit 2, it is necessary to mount the low noise amplifiers 5 on the back surface of the lower grounding conductor 1 and to connect the low noise amplifiers 5 to the feeder circuit 2 by using metal pins 9 or the like.

The conventional radiowave receiving array antenna having the construction described above had disadvantages as follows. The structure for connecting the low noise amplifiers and the feeder circuit is complicated to thereby increases cost. Further, since the low noise amplifiers are mounted on the back surface of the lower grounding conductor, the thickness of the antenna device is increased. When the array antenna is prepared for outdoor use, a cover for protecting the low noise amplifiers is additionally needed, whereby the construction is further complicated and cost is further increased.

Accordingly, it is an object of the present invention to reduce the radiowave receiving array antenna increase with respect to the mounting of the low noise amplifiers.

SUMMARY OF THE INVENTION

In accordance with the present invention there is provided a radiowave receiving array antenna comprising a lower grounding conductive plate, a first supporting plate made of a foamed resinous material which is overlaid on the lower grounding conductive plate, a feeder circuit board comprising a feeder circuit and radiation elements formed on an insulating film which is overlaid on the first supporting plate, a second supporting plate made of a foamed resinous material which is overlaid on the feeder circuit plate, an upper grounding conductive plate made of a metallic substance, overlaid on the second supporting plate, in which radiation windows are formed at positions corresponding to the radiation elements and low noise amplifiers, characterized in that said low noise amplifiers are mounted on spaces formed by thinning out a part of the radiation elements on the feeder circuit board.

In accordance with the present invention, there is provided a radiowave receiving array antenna comprising a lower grounding conductive plate, a first supporting plate made of a foamed resinous material which is overlaid on the lower grounding conductive plate, a feeder circuit board comprising a feeder circuit and radiation elements formed on an insulating film which is overlaid on the first supporting plate, a second supporting plate made of a foamed resinous material which is overlaid on the feeder circuit plate, an upper grounding conductive plate made of a metallic substance, overlaid on the second supporting plate, in which radiation windows are formed at positions corresponding to the radiation elements and low noise amplifiers, characterized in that said low noise amplifiers are mounted on microstrip lines at spaces formed by thinning out a part of the radiation elements on the feeder circuit board, and a converting device comprising a rectangular coaxial member is inserted between a microstrip line and a triplate line of the feeder circuit.

In accordance with the present invention, there is provided a radiowave receiving array antenna comprising a lower grounding conductive plate, a first supporting plate made of a foamed resinous material which is overlaid on the lower grounding conductive plate, a feeder circuit board comprising a feeder circuit and radiation elements formed on an insulating film which is overlaid on the first supporting plate, a second supporting plate made of a foamed resinous material which is overlaid on the feeder circuit board, an upper grounding conductive plate made of a metallic substance, overlaid on the second supporting plate, in which radiation windows are formed at positions corresponding to the radiation elements and low noise amplifiers, characterized in that said low noise amplifiers are mounted on spaces formed by thinning out a part of the radiation elements on the feeder circuit board, and a power source line for the low noise amplifiers is formed on the upper grounding conductive plate.

In accordance with the present invention, there is provided a radiowave receiving array antenna comprising a lower grounding conductive plate, a first supporting plate made of a foamed resinous material which is overlaid on the lower grounding conductive plate, a feeder circuit board comprising a feeder circuit and radiation elements formed on an insulating film which is overlaid on the first supporting plate, a second supporting plate made of a foamed resinous material which is overlaid on the feeder circuit board, an upper grounding conductive plate made of a metallic substance, overlaid on the second supporting plate, in which radiation windows are formed at positions corresponding to the radiation elements and low noise amplifiers, characterized in that said low noise amplifiers are mounted on spaces formed by thinning out a part of the radiation elements on the feeder circuit board; said upper grounding conductive plate is arranged at the lower surface of a double-side-metal-sheet-lined substrate; and a power source line for the low noise amplifiers is formed on said substrate.

In accordance with the present invention, connection of the low noise amplifiers to the feeder circuit is simple because the low noise amplifiers are mounted on the same plane as the feeder circuit. The low noise amplifiers are generally formed on microstrip lines. Insertion of the converting device comprising a rectangular coaxial member between a triplate line and a microstrip line in the feeder circuit assures effective conversion and provides a simple and efficient structure.

When the array antenna of the present invention is in outdooruse, the upper grounding conductor is covered by a radome. Accordingly, the low noise amplifiers can be mounted, without the necessity of an additional protecting means, by arranging the power source lines for the amplifiers on the upper earthing conductor. The power source lines for the upper grounding conductor and the low noise amplifiers are formed, by etching or the like, on both surfaces of a double-side-metal-sheet-lined substrate, whereby the number of elements can be reduced so that the manufacturing cost can be reduced.

DETAILED DESCRIPTION

The following, preferred embodiments of the radiowave receiving array antenna according to the present invention will be described with reference to the figures.

Figure 1A:
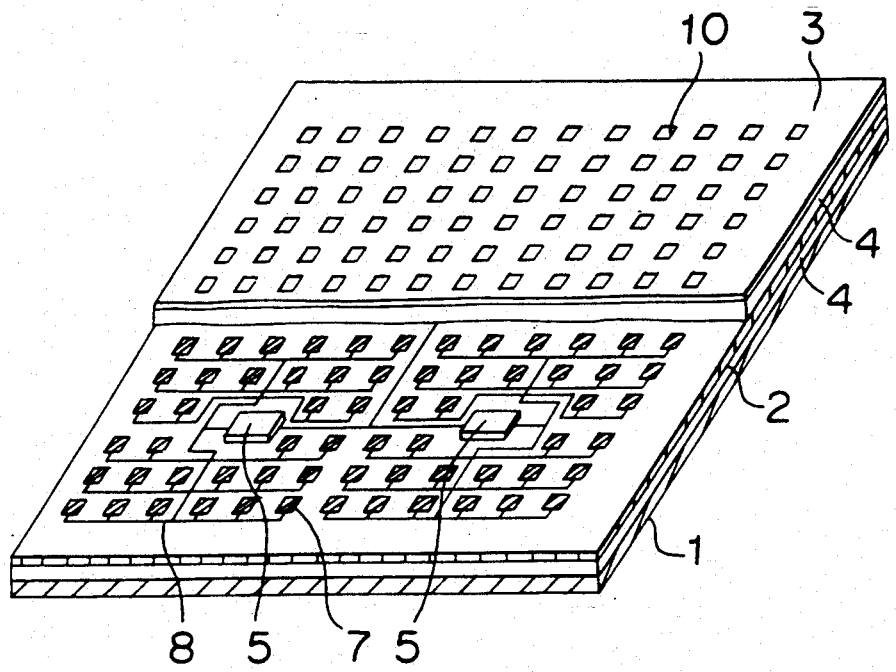
FIG. 1*a* is a perspective view partly removed of an embodiment of the radiowave receiving array antenna according to the present invention.
Figure 1B:
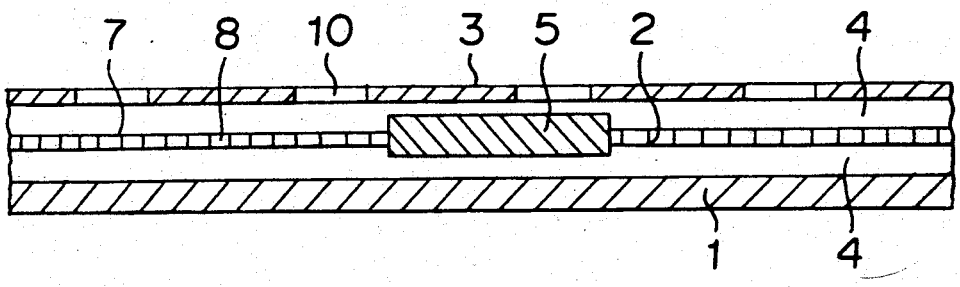
FIG. 1*b*is a longitudinal cross-sectional view in an enlarged scale of the array antenna shown in FIG. 1*a;*

In FIGS. 1*a* and 1*b*, reference numeral 1 designates a lower grounding conductor or a lower grounding conductive plate, numeral 2 designates a feeder circuit board comprising an insulating film on which a feeder circuit is formed, numeral 3 designates an upper grounding conductor or an upper grounding conductive plate made of a metallic substance, numerals 4 designate first and second supporting plates made of a foamed resinous material, numeral 5 designate low noise amplifiers, numeral 7 designate a number of radiation elements formed on the insulating film which is overlaid on the first supporting plate 4, numeral 8 designates the feeder circuit, numeral 10 designate a number of radiation windows formed in the upper grounding conductor 3. The feeder circuit board 2 is sandwiched between the first and second supporting plates 4; the upper grounding conductor 3 is overlaid on the other surface of the first supporting plate 4 and the lower grounding conductor 1 is overlaid on the other surface of the second supporting plate 4.

Figure 5A:
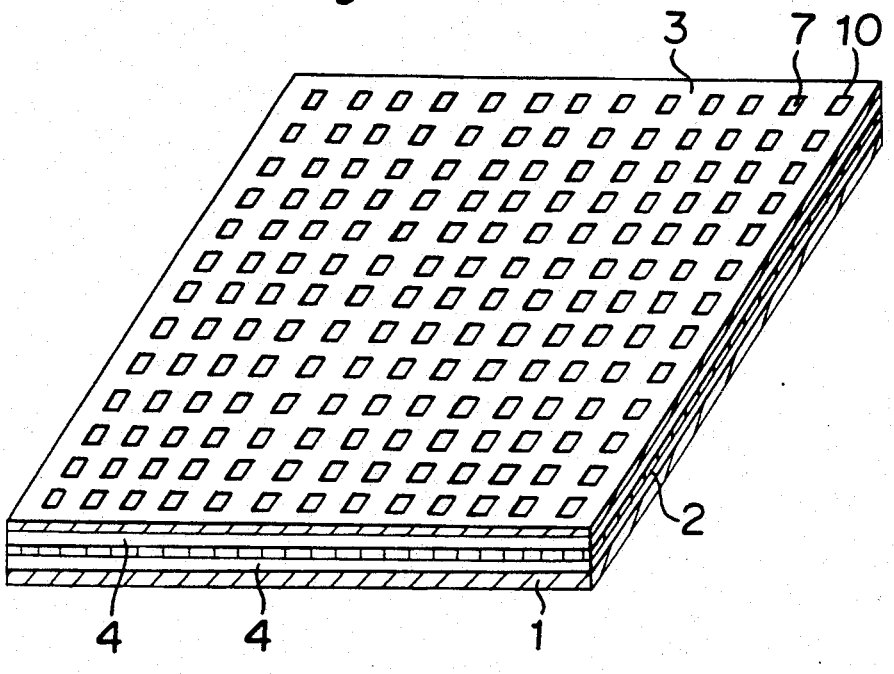
FIG. 5*a* is a perspective view of a conventional radiowave receiving array antenna.
Figure 5B:
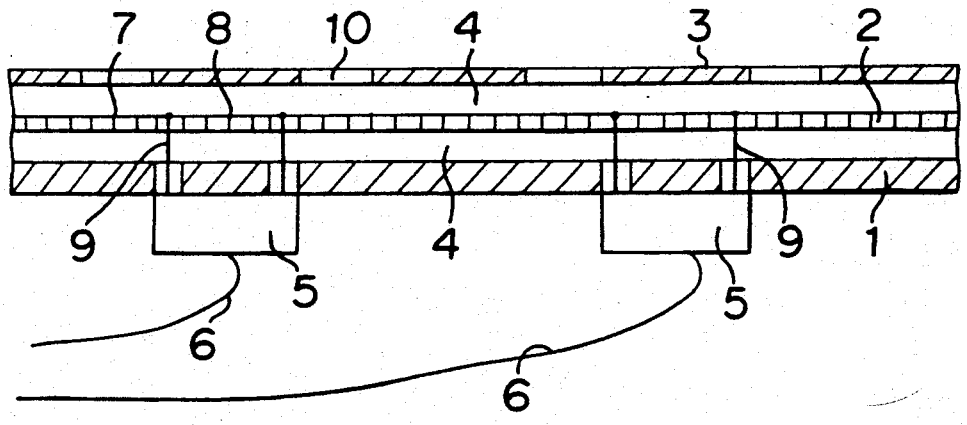
FIG. 5*b* is a longitudinal cross-sectional view in an enlarged scale of the array antenna shown in FIG. 5*a.*

In FIGS. 1*a* and 1*b*, the low noise amplifiers 5 are mounted on the same plane as the feeder circuit board 2. In comparison with the conventional technique wherein the low noise amplifiers are mounted on the back surface of the lower grounding conductor 1 (FIGS. 5*a* and 5*b*), it is unnecessary to provide means for connecting the low noise amplifiers 5 to the feeder circuit 8, on the lower grounding conductor 1. Further, it is unnecessary to provide a cover for protecting the low noise amplifiers 5. In order to mount the low noise amplifiers on the same plane as the feeder circuit board 2, it is necessary to create spaces by sacrificing a part of the radiation elements 7. However, if the number of the radiation elements is sufficiently large, the deterioration of the characteristics of the antenna due to the reduction of the number of the radiation elements is negligible.

In this respect, more detailed description will be made. The gain G of an array antenna is expressed by the following formula:

$$G=G_e+10\log N+\eta-L\ (dB) \tag{1}$$

where G is the gain of elements, N is the number of elements, $\eta$ is opening efficiency ($<0$) and L is current feeding loss ($>0$). Accordingly, a change of gain $\Delta G$ caused by reducing a part of radiation elements is expressed by the following formula:

$$\Delta G=10\log (N_1/N_2) \tag{2}$$

Where $N_1$ is the number of elements after reducing some elements and $N_2$ is the number of elements before the reducing of the number of the elements.

If the tolerance of $\Delta G$ is determined to be $-0.2$ dB or less, then $N_1/N_2 \doteq 0.955$. Namely, when there is an antenna having $N_2=100$, it is possible to reduce 4 radiation elements.

Figure 2A:
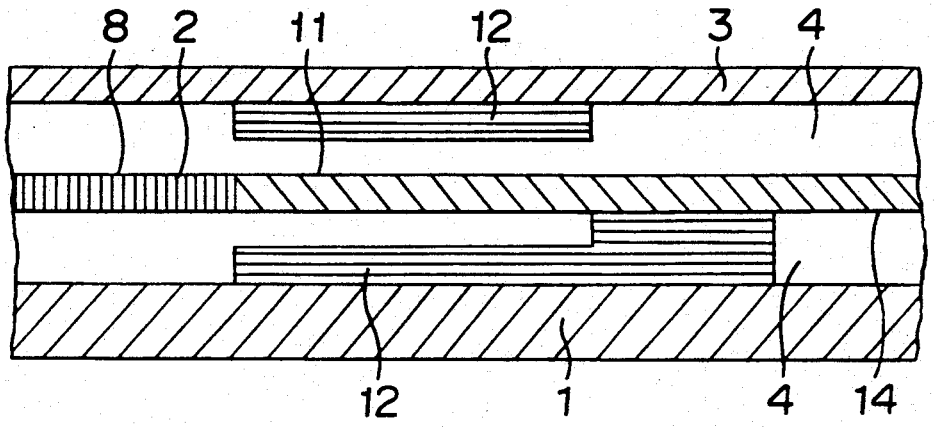
FIG. 2*a* is a longitudinal cross-sectional view partly broken in an enlarged scale of another embodiment of the radiowave receiving array antenna according to the present invention.
Figure 2B:
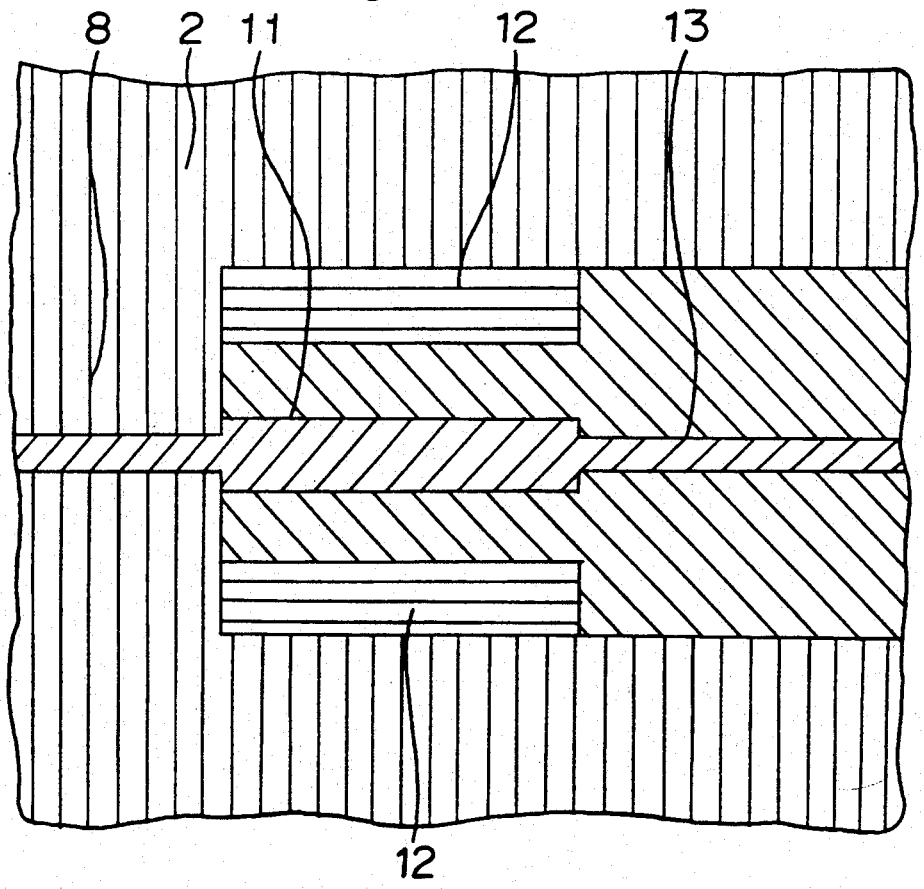
FIG. 2*b* is an enlarged vertical cross-sectional view of the array antenna shown in FIG. 2*a;*

FIGS. 2*a* and 2*b* show another embodiment of the array antenna according to the present invention. In FIGS. 2*a* and 2*b*, the same reference numerals as in FIGS. 1*a* and 1*b* designate the same element, and therefore, description of these elements is omitted. In FIGS. 2*a* and 2*b*, reference numeral 11 designates a rectangular coaxial type inner conductor, numeral 12 designates a rectangular coaxial type outer conductor, numeral 13 designates a microstrip line for a low noise amplifier, and numeral 14 designates an FIGS. 2*a* and 2*b* conductor for the microstrip line 16.

In the embodiment shown in FIGS. 2*a* and 2*b*, the rectangular coaxial type inner and outer conductors 11, 12 constitutes a converting device. The insertion of the converting device between the microstrip line and a triplate line suppressed the deterioration of efficiency of transmitting electromagnetic waves. The deterioration of the transmission efficiency is caused because the microstrip line forms an imbalance type transmission path and the triplate line forms a balance type transmission path, and therefore, if the both lines are directly connected, imbalanced, undesired electromagnetic waves are produced at the connection area so as to keep the continuity of electric field, to thereby deteriorate the transmission efficiency. The rectangular coaxial type converting device forms a balance type transmission path. When the converting device is inserted between the microstrip line and the triplate line, electromagnetic waves produced at the connection area is of a waveguide mode because the connection area is entirely surrounded by a metallic substance.

In the embodiment as shown in FIGS. 2*a* and 2*b*, the converting device comprising rectangular coaxial type inner and outer conductors is inserted in a converting section where there are the microstrip line 13 for a low noise amplifier and the triplate line in the feeder circuit 8, wherein the dimension of the longer inner side of the outer conductor is determined to be able to cut off a waveguide mode at an available frequency. The cut-off frequency of the waveguide mode is given by the formula: $f=c/(2a)$, where f is cut-off frequency, c is the velocity of light and a is the dimension of longer inner side of the outer conductor. In the above-formula, the deterioration of the transmission efficiency can be controlled by setting the value of f to be higher than a frequency used. Accordingly, occurrence of a useless mode can be suppressed with a simple structure, and conversion can be effectively done.

Figure 3A:
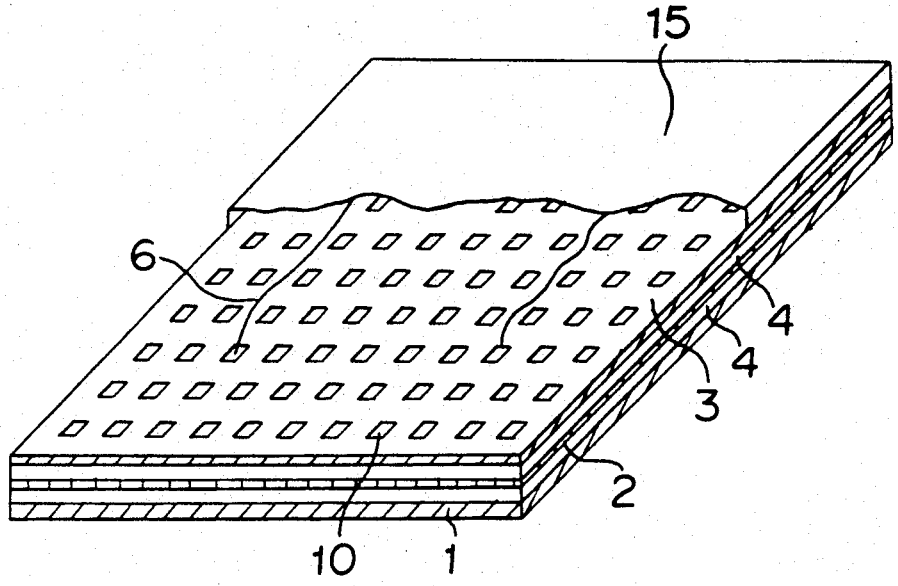
FIG. 3*a* is a perspective view partly removed of another embodiment of the radiowave receiving array antenna of the present invention.
Figure 3B:
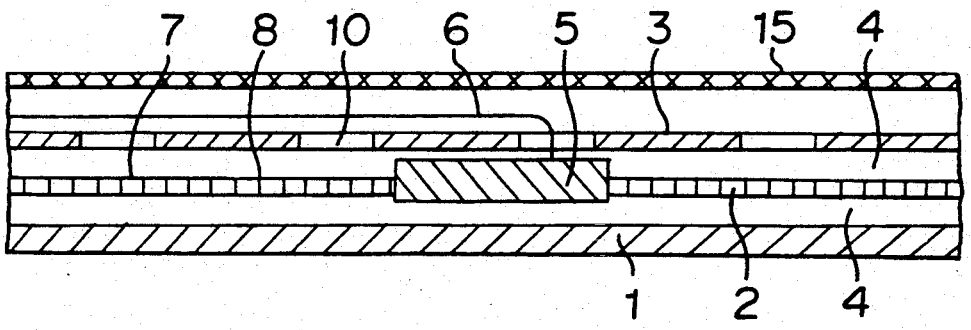
FIG. 3*b* is a longitudinal cross-sectional view partly broken in an enlarged scale of the array antenna shown in FIG. 3*a;*

FIGS. 3*a* and 3*b* shows another embodiment of the antenna array according to the present invention. In FIGS. 3*a* and 3*b* show the same reference numerals as in FIGS. 1*a* and 1*b* designate the same elements except that the array antenna of this embodiment has a radome 15. The radome 15 is generally attached to an array antenna for outdoor use. Accordingly, by arranging the power source lines 6 for the low noise amplifiers between the upper grounding conductor 3 and the radome 15, it is unnecessary to provide an additional protecting means for the power source lines 6.

Figure 4A:
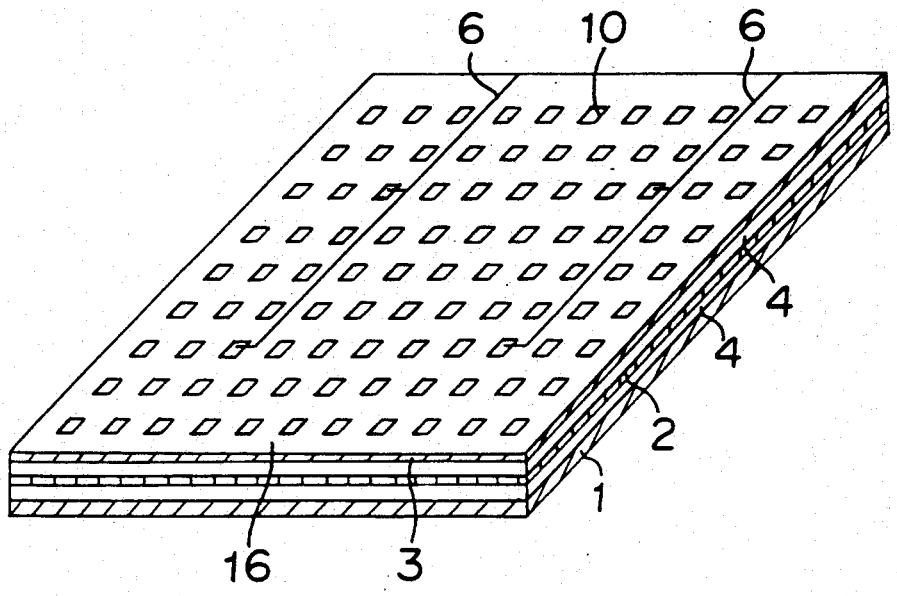
FIG. 4*a* is a perspective view of another embodiment of the radiowave receiving array antenna according to the present invention.
Figure 4B:
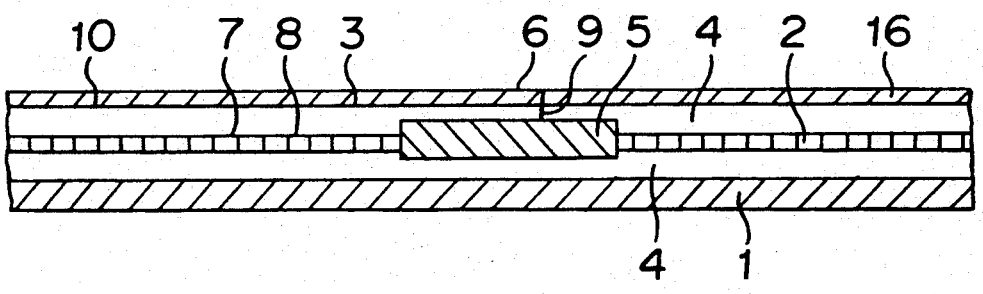
FIG. 4*b* is a longitudinal cross-sectional view partly broken in an enlarged scale of the array antenna shown in FIG. 4*a;*

FIGS. 4*a* and 4*b* show another embodiment of the array antenna according to the present invention. In FIGS. 4*a* and 4*b*, the same reference numerals as in FIG. 1 designate the same or corresponding elements except that numeral 9 designate metal pins and numeral 16 designates a double-side-metal-sheet-lined substrate.

In the embodiment shown in FIGS. 4*a* and 4*b*, the upper grounding conductor 3 and the power source lines 6 are formed, by etching or the like, on both surfaces of a single double-side-metal-sheet-lined substrate, whereby the number of structural elements can be further reduced.

Thus, in accordance with the present invention, low noise amplifiers are mounted on the same plane as a feeder circuit, or power source lines are arranged on the upper grounding conductor, whereby the construction of an array antenna can be simplified and the manufacturing cost can be reduced.

We claim:

1. A radiowave receiving array antenna, comprising:

a lower grounding conductive plate, a first supporting plate made of foamed resinous material which is overlaid on the lower grounding conductive plate, a feeder circuit board overlaid on the first supporting plate and including an insulating film, a second supporting plate made of a foamed resinous material which is overlaid on the feeder circuit board, an upper grounding conductive plate made of a metallic substance, overlaid on the second supporting plate, in which radiation windows are formed at a plurality of positions;

a plurality of radiation elements, a feeder circuit and low noise amplifiers, formed on the insulating film, said low noise amplifiers and said radiation elements being mounted on the same plane of the insulating film at positions corresponding to the radiation windows.

2. The radiowave receiving array antenna of claim 1, further comprising: a power source line for the low noise amplifiers formed on the upper earthing conductive plate.

3. The radiowave receiving array antenna of claim 1, wherein said upper grounding conductive plate is arranged at the lower surface of a double-side-metal-sheet-line substrate; and further comprising a power source line for the low noise amplifier formed on said substrate.

4. A radiowave array antenna, comprising:

a lower grounding conductive plate, a first supporting plate made of a foamed resinous material which is overlaid on the lower grounding conductive plate, a feeder circuit board overlaid on the first supporting plate and including an insulating film, a second supporting plate made of a foamed resinous material which is overlaid on the feeder circuit board, an upper grounding conductive plate made of a metallic substance, overlaid on the second supporting plate, in which radiation windows are formed at a plurality of positions a plurality of radiation elements, a feeder circuit and low noise amplifiers formed on the insulating film, said low noise amplifiers being mounted on microstrip lines on the insulating film, and said low noise amplifiers and said radiation elements being mounted on the same plane of the insulating film, and a converting device formed of rectangular coaxial members inserted between a microstrip line and triplate lien of the feeder circuit.

5. In a radiowave receiving array antenna having a grounding conductive plate having radiation windows formed therein at a plurality of positions, a feeder circuit board comprising:

an insulating film;

a plurality of radiation elements, a feeder circuit and low noise amplifiers, formed on the insulating film, and the low noise amplifiers and the radiation elements being mounted on the same plane of the insulating film at positions corresponding to the radiation windows.

6. The radiowave receiving array antenna of claim 5, further comprising:

a power source lien for the low noise amplifiers formed on the grounding conductive plate.

7. The radiowave receiving array antenna of claim 5, wherein the grounding conductive plate is arranged at the lower surface of a double-side-metal-sheet-line substrate; and further comprising a power source lien for the low noise amplifier formed on the substrate.

8. In a radiowave receiving array antenna having a grounding conductive plate having radiation windows formed therein at a plurality of positions, a feeder circuit board comprising:

an insulating film;

a plurality of radiation elements, a feeder circuit and low noise amplifiers formed on the insulating film, the low noise amplifiers being mounted on microstrip lines on the insulating film, and the low noise amplifiers and the radiation elements being mounted on the same plane of the insulating film, and a converting device formed of rectangular coaxial members inserted between a microstrip lien and a triplate lien of the feeder circuit.

* * * * *